US006351240B1

(12) United States Patent
Karimullah et al.

(10) Patent No.: US 6,351,240 B1
(45) Date of Patent: Feb. 26, 2002

(54) CIRCULARLY POLARIZED REFLECT ARRAY USING 2-BIT PHASE SHIFTER HAVING INITIAL PHASE PERTURBATION

(75) Inventors: Khalid Karimullah, Olney; Jian Song, Germantown; Lin-Nan Lee, Potomac; Stanley E. Kay, Rockville, all of MD (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/664,695

(22) Filed: Sep. 19, 2000

Related U.S. Application Data

(60) Provisional application No. 60/184,988, filed on Feb. 25, 2000.

(51) Int. Cl.[7] ..... H01Q 1/38

(52) U.S. Cl. ..... 343/700 MS; 343/829; 343/846; 343/853

(58) Field of Search ..... 343/700 MS, 846, 343/853, 829

(56) References Cited

U.S. PATENT DOCUMENTS 4,379,296 A * 4/1983 Farrar et al. ..... 343/700 MS
4,410,891 A * 10/1983 Schaubert et al. ... 343/700 MS
4,777,490 A * 10/1988 Sharma et al. ..... 343/700 MS

* cited by examiner

*Primary Examiner*—Don Wong
*Assistant Examiner*—Hoang Nguyen
(74) *Attorney, Agent, or Firm*—John T. Whelan; Michael W. Sales

(57) ABSTRACT

An approach for electronically performing beam steering is disclosed. For electronic scanning, an n-bit quantized phase shifting approach is employed at each array element of a phased array antenna. By applying an initial phase bias, either deterministically or randomly, in each of the array elements, the performance of a phased array with n-bit quantization (even with n=2) approaches the performance of a system with no quantization. This approach can be used with linearly polarized or circularly polarized waves. For circularly polarized waves, the $2^n$ phase shifts required of n-bit quantization are achieved in a manner that provides a simple, low-loss construction, which allows production of a low-cost reflectarray or a flat-plate lens.

27 Claims, 8 Drawing Sheets

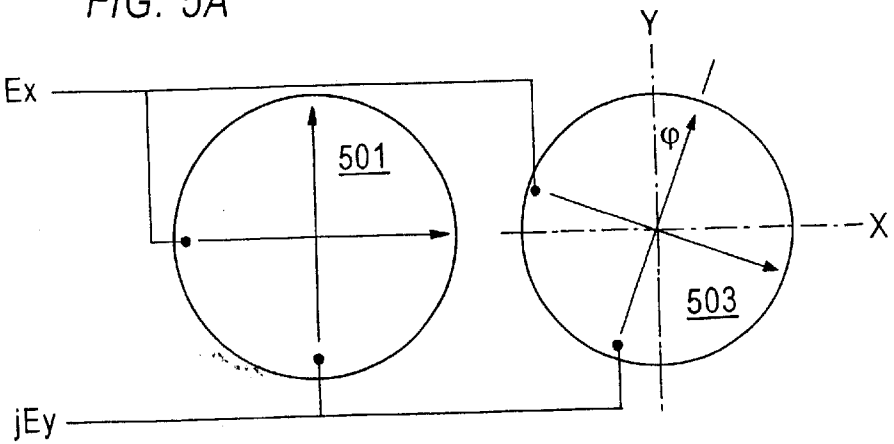
FIG. 5A
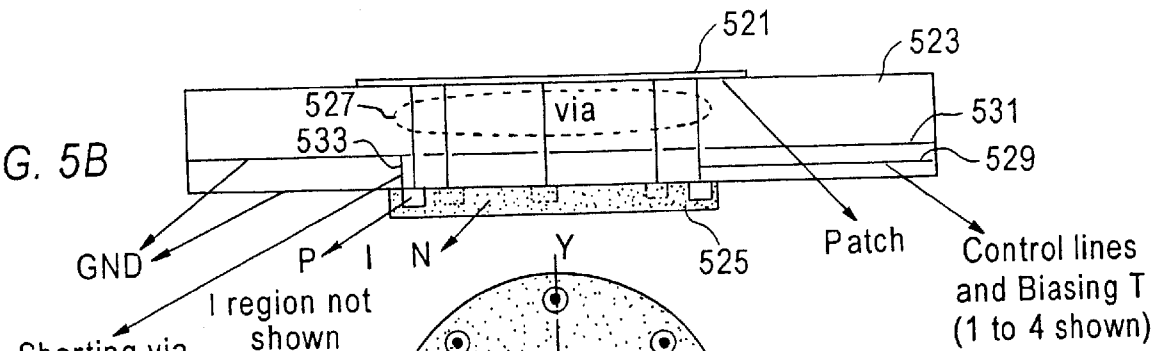
FIG. 5B
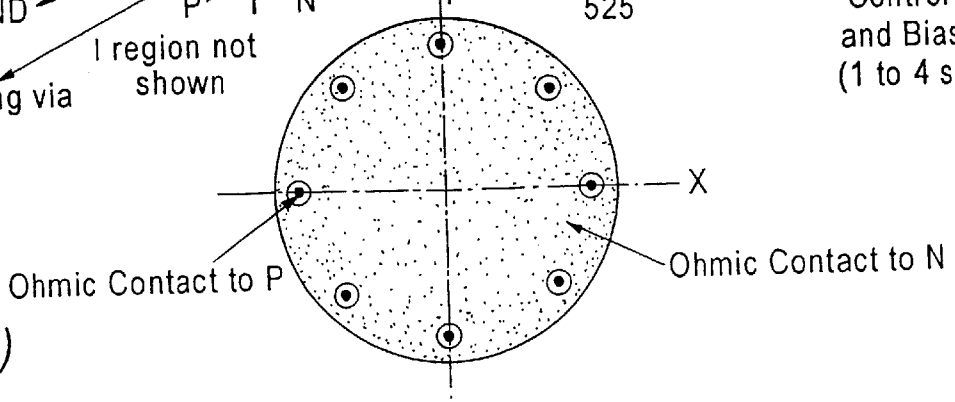
FIG. 5B(1)

CIRCULARLY POLARIZED REFLECT ARRAY USING 2-BIT PHASE SHIFTER HAVING INITIAL PHASE PERTURBATION

CROSS-REFERENCES TO RELATED APPLICATION

This application is related to, and claims the benefit of the earlier filing date of, U.S. Provisional Patent Application 60/184,988 filed Feb. 25, 2000, entitled "Circularly Polarized Reflectarray Using 2-Bit Phase Shifter Having Initial Phase Perturbation," the entirety of which is incorporated herein by reference.

BACKGROUND OF THE INVENTION

1. Field of the Invention

The present invention relates generally to electronically steerable antenna systems, and is more particularly related to a phased array utilizing n-bit phase quantization.

2. Discussion of the Background

Communication and radar systems provide sophisticated applications that require accurately directing high-gain beams toward distant receivers/transmitters or targets. Phased array antennas are particularly suited to electronically steering directive beams, as the individual array elements can be controlled independently to exhibit a particular amplitude and phase. Advances in the capability to individually control these array elements without mechanical motion have lead to enhancements in scanning speed and improved ability to program the beams. In operation, a scanning beam changes direction incrementally in one or both of azimuth and elevation.

Phase shifters are widely used to accomplish electronic beam steering. The ability to control these phase shifters determines the speed and accuracy of switching beams; with rapid switching of beams, for example, a radar system is able to perform multiple functions, allowing the radar to track numerous targets. Further, steerable antennas are used, for example, in subscriber terminals and in earth stations that have to track a communication satellite. For electronic steering, traditional phased array antennas are expensive and are based on conventional phase shifters.

The phase shifting devices in modern phase array antenna systems are typically digital phase shifters. Unfortunately, digital phase shifters produce a phase quantization error, which increases the pointing error of the antenna beam and antenna pattern sidelobe levels. That is, the use of digital phase shifters for beam steering or other purposes introduces quantization errors, which degrades the antenna performance. Recent applications of phased array radars require higher angular measurement for antenna beam steering accuracy, thereby requiring the phase quantization errors of digital phase shifters to be reduced significantly.

FIG. 11 shows one conventional approach to design of a phased array antenna utilizing a 2-bit phase shifter. In this approach, a circular patch 1100 includes eight taps that are situated around the periphery of the circular patch 1100 at positions 1–8. Each of the taps has a corresponding switch; that is, taps 1–8 are connected to switches 1101–1108, respectively. Four phases (0°, 90°, 180°, and 270°) are generated by switching on the appropriate set of switches 1101–1108 associated with a pair of taps, which are directly opposite each other. Table 1, below, lists the pairing of taps and the corresponding phase.

TABLE 1

| TAP PAIRS | PHASE |
|---|---|
| 1–5 | 0°, 360° |
| 2–6 | 90° |
| 3–7 | 180° |
| 4–8 | 270° |

As indicated in the above table, taps 1 and 5 are shorted using switches 1101 and 1105 to signify a 0° (360°) phase, while the remaining taps 2-4, and 6-8 are open. Switches 1102 and 1106, which are connected to taps 2 and 6, respectively, are closed to yield 90°. Taps 3 and 7 are shorted to obtain 180°; i.e., the corresponding switches 1103 and 1107 are closed. Further, closing switches 1104 and 1108, associated with taps 4 and 8, results in a 270° phase.

Under this approach, the circular patch 1100 is shorted to ground at the opposite ends of only one axis to support circularly polarized (CP) waves. The shorted points are effectively moved around the periphery to achieve phase shifts for CP waves. This type of patch 1100 requires different EM (electromagnetic) modes in the two orthogonal axes; and hence, the axial ratio is negatively affected. Recognizing that signals emitted from the circular patch 1100 possess orthogonal field components, it is observed that the above scheme of shorting opposite taps imposes different boundary conditions on the signals. For instance, to obtain a 0° phase, taps 1 and 5 are shorted; however, the orthogonal taps 3 and 7 are open. Accordingly, the different boundary conditions exist for the orthogonal EM modes associated with the 0° phase signal. Therefore, axial ratio degradation poses a problem, resulting in poor system performance.

Turning back to the issue of quantization error arising from the use of digital phase shifters, traditional antenna systems employ relatively high quantization levels to minimize such error. For example, 3 or 4-bit phase quantization has been used in phase shifter designs for beam steering to achieve acceptable performance from arrays. Coarser quantization, such as 2-bit phase quantization, has been viewed as lacking in performance. Additionally, conventional implementation of n-bit quantized phase shifters is prone to RF (radio frequency) losses. Nonetheless, higher bit phase quantization has been widely deployed. However, such a solution results in greater complexity and cost. Therefore, it is desirable from the perspective of reduced circuit complexity to use coarse quantization.

FIG. 12 shows the effect of 2-bit quantization in a conventional phase array antenna. As seen in the figure, strong quantization sidelobes appear. The presence of such prominent sidelobes impacts directivity negatively. Further, these sidelobes can potentially cause a violation of the emission specification of the antenna system.

Based on the foregoing, there is a clear need for improved approaches for providing electronically steerable antennas.

There is also a need to simplify the control circuitry associated with the array antenna.

There is also a need to enhance performance of the array antenna by reducing interference and signal degradation.

There is also a need to reduce the production costs of the array antenna.

Based on the need to increase antenna efficiency and minimize cost, an approach for electronically steering a beam utilizing simplified circuitry without reducing performance is highly desirable.

SUMMARY OF THE INVENTION

According to one aspect of the invention, a method is provided for performing electronic beam steering using a circular patch that has a plurality of taps coupled to a plurality of switches. The method includes controlling the plurality of switches to short an orthogonal pair of the plurality of taps. The taps are arranged on the circular patch to provide identical boundary conditions. The method also includes selectively performing at least one of receiving a signal and transmitting the signal. Under this approach, antenna circuitry is simplified, thereby reducing production cost.

According to another aspect of the invention, an antenna apparatus comprises a circular patch having a plurality of orthogonal tap pairs arranged on the patch. A plurality of switches correspond to the taps, in which each of the switches is coupled to ground. A controller is configured to control the switches to short one of the orthogonal tap pairs corresponding to a phase shift of a signal having orthogonal EM (electromagnetic) modes. The above arrangement advantageously provides enhanced performance of the antenna system.

According to another aspect of the invention, an antenna system for beam steering comprises a plurality of antenna elements being spaced according to a predetermined distance value. Each of the plurality of antenna elements includes a circular patch that has a plurality of orthogonal tap pairs arranged on the patch. A plurality of switches are correspondingly connected to the taps, in which each of the switches is coupled to ground. A plurality of phase perturbing sources are coupled to the taps to apply a fixed phase bias of a predetermined distribution. The predetermined distribution is at least one of a deterministic distribution and a random distribution. A controller is configured to control individually the plurality of antenna elements. The controller controls the switches of one of the plurality of antenna elements to short one of the orthogonal tap pairs corresponding to a phase shift of a signal having orthogonal EM (electromagnetic) modes, wherein the circular patch as controlled by the controller provides identical boundary conditions for the orthogonal EM modes. The above arrangement advantageously provides reduced signal degradation.

In yet another aspect of the invention, a computer-readable medium carrying one or more sequences of one or more instructions for performing electronic beam steering using a circular patch having a plurality of taps coupled to a plurality of switches is disclosed. The one or more sequences of one or more instructions include instructions which, when executed by one or more processors, cause the one or more processors to perform the step of controlling the plurality of switches to short an orthogonal pair of the plurality of taps. The taps are arranged on the circular patch to provide identical boundary conditions. Another step includes selectively performing at least one of receiving a signal and transmitting the signal. This approach advantageously reduces the number of switch components in an antenna system.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 5A and 5B are diagrams showing the phasing shifting operation of a circular patch and of a particular PIN diode implementation of an array element, respectively, in accordance with an embodiment of the present invention;

DESCRIPTION OF THE PREFERRED EMBODIMENTS

In the following description, for the purpose of explanation, specific details are set forth in order to provide a thorough understanding of the invention. However, it will be apparent that the invention may be practiced without these specific details. In some instances, well-known structures and devices are depicted in block diagram form in order to avoid unnecessarily obscuring the invention.

The present invention uses an n-bit quantized phase shifting approach with each array element of a phased array antenna system. The antenna system includes a circular patch that has multiple orthogonal taps pairs that are arranged on the periphery of the circular patch. Each of the taps has a corresponding switch that is coupled to ground. A controller controls the switches to short orthogonal tap pairs. The orthogonal tap pairs represent a phase of a signal that has orthogonal EM (electromagnetic) modes. The patch is controlled by the controller such that the patch provides identical boundary conditions for the orthogonal EM modes. Further, a deterministic or random phase perturbation is applied to the signals to improve antenna performance of an array utilizing n-bit phase quantization.

Although the present invention is discussed with respect to reflectarrays and lens, other equivalent antenna systems are applicable.

Figure 1:
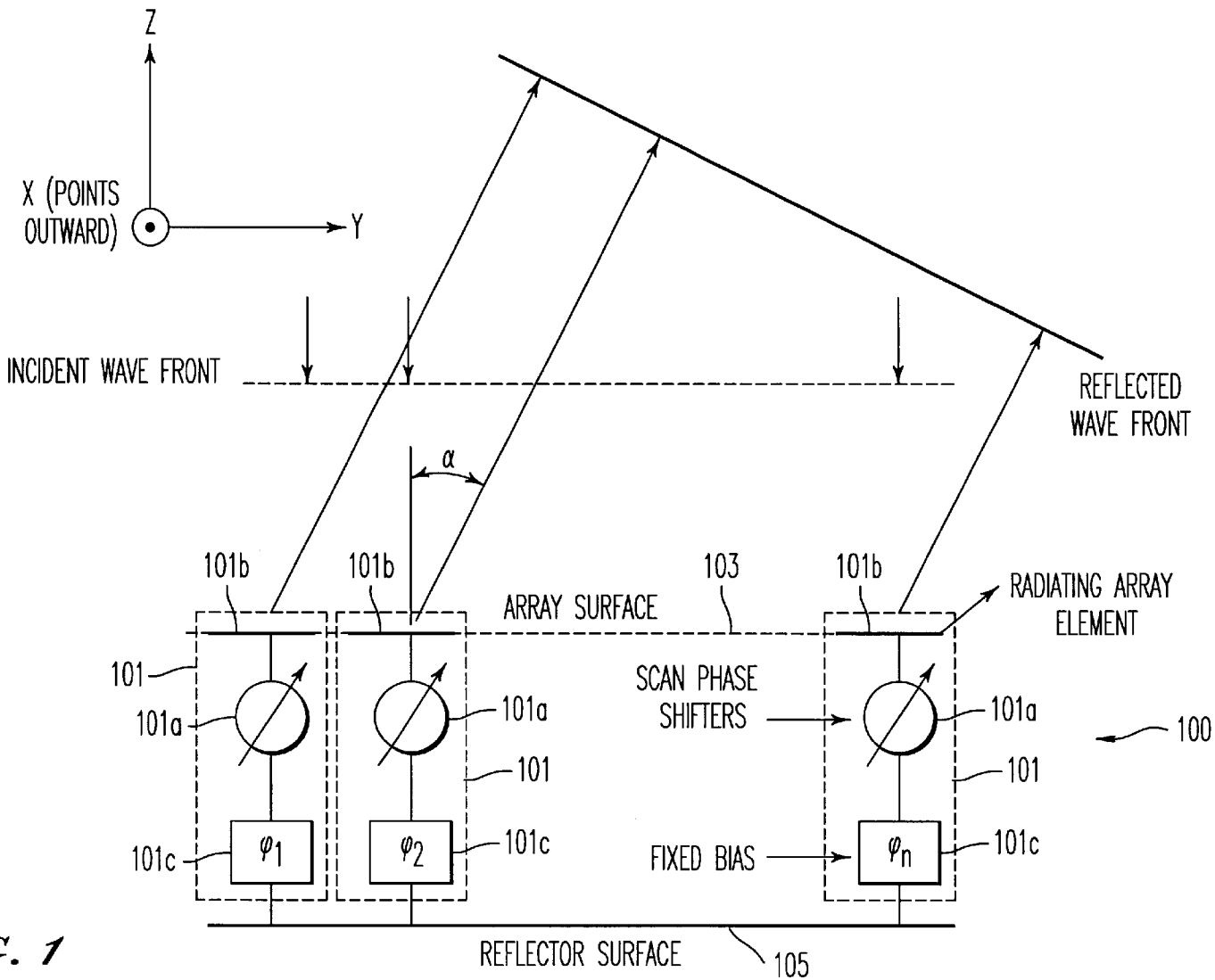
FIG. 1 is a functional and structural diagram of a reflectarray design according to an embodiment of the present invention.

FIG. 1 shows a functional and structural diagram of a reflectarray design according to an embodiment of the present invention. The reflectarray 100 of FIG. 1 is an Electronically Steerable Reflectarray (ESRA), which possesses numerous array elements 101. Each of these array elements 101 contribute to the aperture of the reflectarray 100 and is capable of individual control with respect to phase and amplitude.

An electromagnetic wave is shown to be incident on the array surface 103. Each array element 101 receives a fixed incident phase that may differ from one array element 101 to another; the difference stems largely from the feed placement. In this example, for the purposes of explanation, a wave front (i.e., a surface containing points with identical phase) is assumed to be a plane parallel to the surface 103 of the array. This assumption hold true if the illuminating point source (not shown in the figure) is located at the z-axis, very far from the array 100. Under such an assumption, each array element 101 receives the same incident phase. At each array element 101, a scan phase shift is applied exclusively for beam steering; this function is shown conceptually as a scan phase shifter 101*a* that is coupled to a radiating element 101*b*. The scan phase shifter 101*a* varies as a function of the scan angle and from array element 101 to array element 101. According to an embodiment of the present invention, a fixed phase shift, denoted as the phase bias, is introduced at each array element 101 to minimize the quantization error that arises from using coarse quantization. The fixed bias is applied via a phase perturbation source 101*c*. As will be more fully discussed with respect to FIGS. 3 and 4, the components 101*a*–101*c* of the array element 101 are implemented as a circular patch.

The reflector surface 105 (or ground surface) causes the signal to reflect back via the same path and radiate off the same array element 101. By definition, the scan phase shift is solely responsible for beam steering, i.e., scan phase shifts applied to each array element 101 causes a reflected plane wave propagating in the direction $\alpha$, the scan angle, from the z-axis.

For electronic scanning, the reflectarray 100 uses an n-bit quantized phase shifting approach with each array element 101. By applying a fixed phase bias using the phase perturbation source 101*c*, the performance of the ESRA 100 with n-bit quantization is significantly improved. The phase perturbation source 101*c* can apply a fixed phase bias that is either deterministic or random in each of the array elements 101. As will become evident in later discussions, the application of a deterministic or random phase bias can significantly improved performance of the ESRA 100, even with n=2. The improved performance is nearly that of no quantization. In contrast, with conventional arrays, 3-bit or 4-bit phase quantization are needed to achieve satisfactory array performance. The present invention permits the use of 2-bit phase quantization, which requires half as many switching elements as compared to 3-bit quantization. In other words, use of 2-bit quantization reduces the number of switching elements and simplifies associated control circuitry. Further, the particular manner in which phase shift is created provides a low-loss ESRA 100 with the advantage of mechanical assembly.

It should be noted that the reflectarray 100 can support use of linearly polarized or circularly polarized waves. For circularly polarized waves, however, the $2^n$ phase shifts required of n-bit quantization are achieved in a manner that provides a simple, low-loss construction, which allows production of a low-cost reflectarray or a flat-plate lens (FIG. 2).

Figure 2:
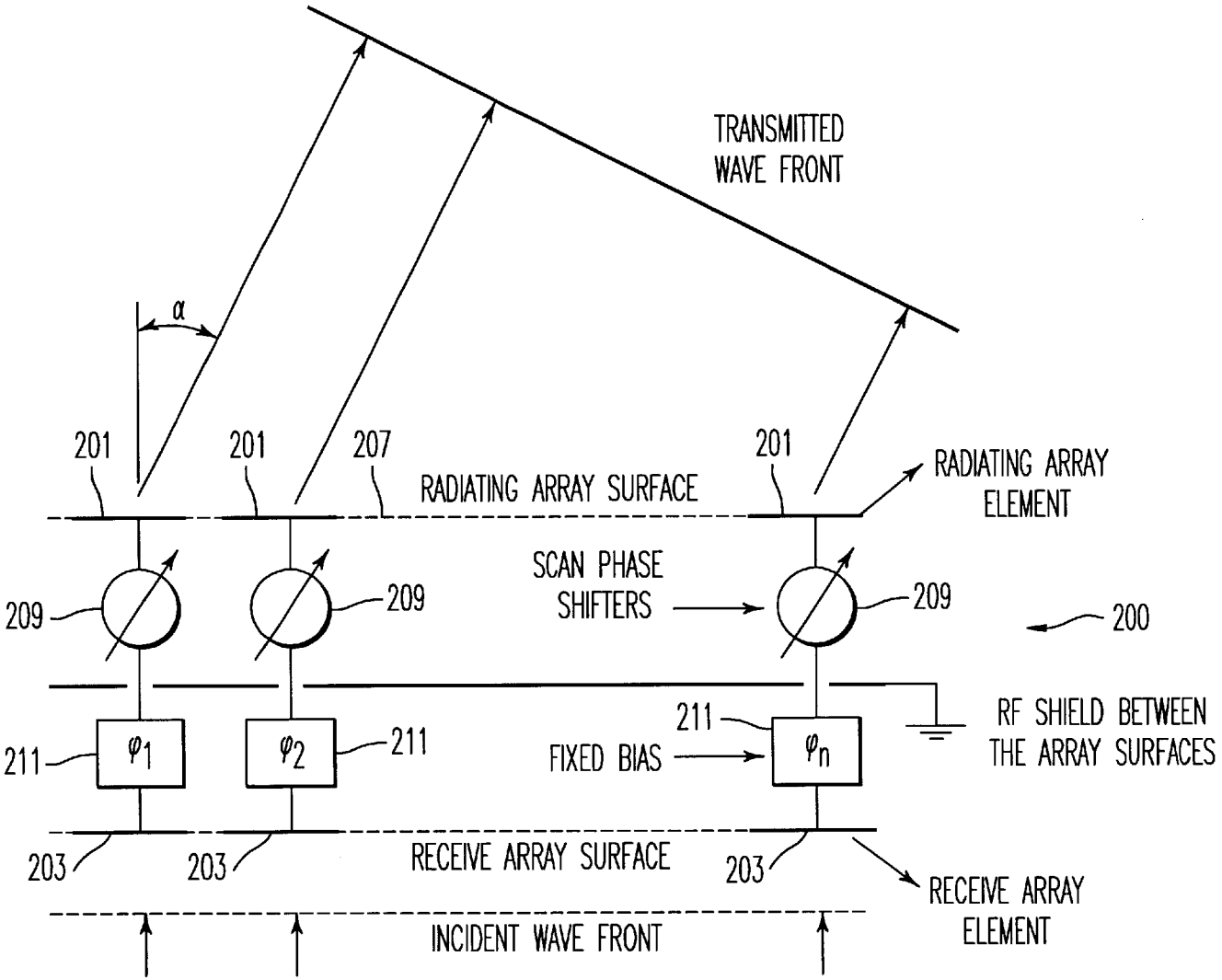
FIG. 2 is a functional and structural diagram of a lens design according to an embodiment of the present invention.

FIG. 2 shows a functional and structural diagram of a lens design according to an embodiment of the present invention. In this architecture, a flat-plate lens 200 is employed. The incident wave is received by a set of array elements 201 on one side of the lens antenna 200, and radiated from another set of array elements 203 on the other side of a ground shield 205. The scan phase shift for steering and the fixed phase bias, are applied as the signal travels from the array elements 203 on the receive surface to the array elements 201 on the radiating surface 207. The scan phase shifters 209 and phase perturbing sources 211 are functional representations and can be integrated as part of the array elements 201 and 203. As seen in FIG. 2, a signal travels through phase shifters 209 and phase perturbing sources 211 only once.

Figure 8:
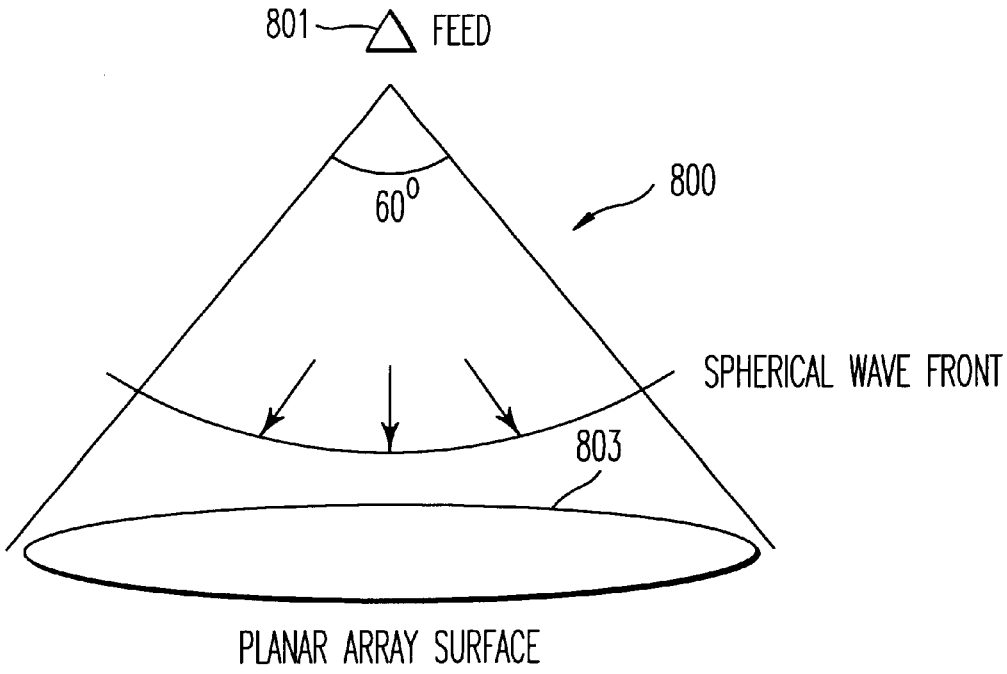
FIG. 8 is a diagram of planar array antenna employing 2-bit quantization and having a feed that originates a spherical wavefront, in accordance with an embodiment of the present invention.

Although it is assumed that the incident phase is constant over all the array elements 203, this assumption need not be made. For example, if the illuminating point source is very close to the array surface, such as a waveguide feed, the wave front will be spherical (FIG. 8). As a result, the incident phase will vary from array element 203 to array element 203, based on the differential phase delay from the feed-point to each array element 203. As will be discussed later, this phase delay is desirable when 2-bit phase quantization is used. Further, the concepts in FIGS. 1 and 2 are explained based on receiving the illumination from a point source from a fixed direction (z-axis) and steering it to some angle as a transmit beam. One of ordinary skill in the relevant art would recognize that the same principles apply to receiving signals from a particular scanned angle and focusing the received signals to a fixed point.

Before further explaining the operation of the present invention, it is instructive to discuss the principles underlying the designs of FIGS. 1 and 2. Considering a planar array surface in the X-Y plane as shown in FIG. 1 or 2, the expression for the far field component at any point $(\theta,\phi)$ in spherical coordinate space, exclusively generated by the nth array element, which is located at normalized coordinates $(x_n,y_n)$ is as follows:

$$E_n(\theta,\phi)=A_n \exp(-j\psi_n)\exp\{2\pi j \sin\theta(x_n \cos\phi+y_n \sin\phi)\} \qquad \text{Eq.(1).}$$

The total far field at $(\theta,\phi)$ is the sum of N such components; N being the number of elements in the array. $A_n$ of Equation (1) is the amplitude taper, which affects the sidelobes of the radiation pattern of the array, and $\psi_n$ is the phase required at each array element for beam steering. It can be shown that, $$\psi_n=2\pi \sin\theta_o(x_n \cos\phi_o+y_n \sin\phi_o), \qquad \text{Eq.(2)}$$

where $\theta_o$ and $\phi_o$ represent the desired coordinates of the beam center. For example, if the beam is to point at the z-axis, then $\theta_o=0$.

In a practical system, it is important to provide the required phase $\psi_n$ at each array element, as accurately as possible, for any arbitrary beam location. Therefore, at each array element, the sum of scan phase shift, the incident phase and the phase bias should equate to $\psi_n$. If Qn, Un and Vn denote the scan phase shift, the incident phase and the phase bias, respectively, at the nth array element, the following relationship exists:

$$\psi_n=Qn+Un+Vn. \qquad \text{Eq.(3)}$$

Figure 12:
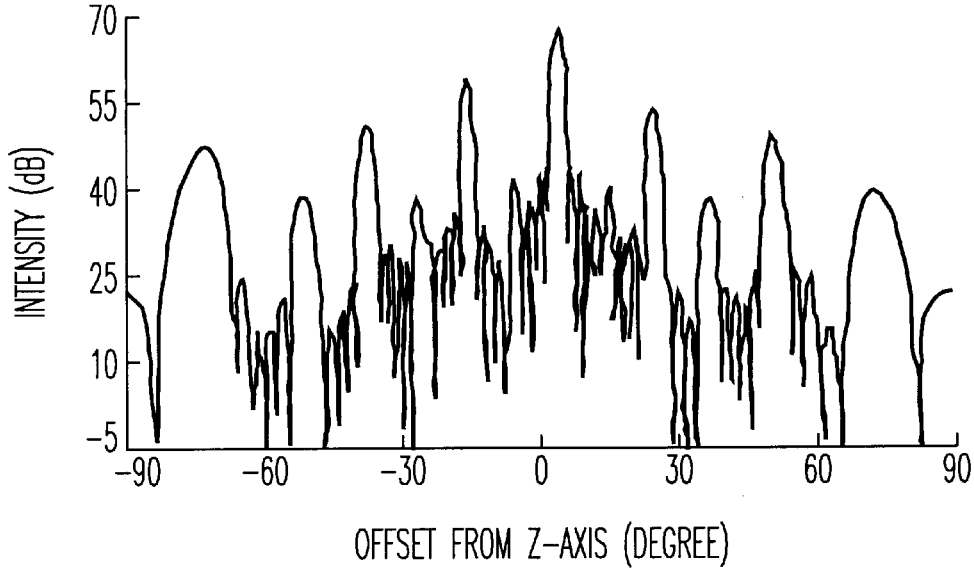
FIG. 12 PRIOR ART
FIG. 12 is a graph of a radiation pattern in which a conventional array antenna employs 2-bit quantization with zero phase bias.

With respect to transmission, the incident phase is based entirely on positioning of the feed (not shown). It is recognized that the phase bias can be a deliberate phase perturbation used in the array design, according to an embodiment of the present invention. If Qn is continuously variable in the range 0°–360°, then there are no issues with respect to quantization errors; such is the case with an analog phase shifter. Analog phase shifters have the drawbacks of being lossy and drifting over temperature. Therefore, digital phase shifters are utilized to overcome these drawbacks. That is, Qn is implemented by using n-bit quantization to achieve low loss and accurate design over temperature. As mentioned previously, the fundamental problem in using quantization with arrays is the appearance of quantization sidelobes (as shown in FIG. 12). However, the present invention suppresses the quantization sidelobes by introducing a fixed bias, as shown in FIGS. 1 and 2.

Figure 3:
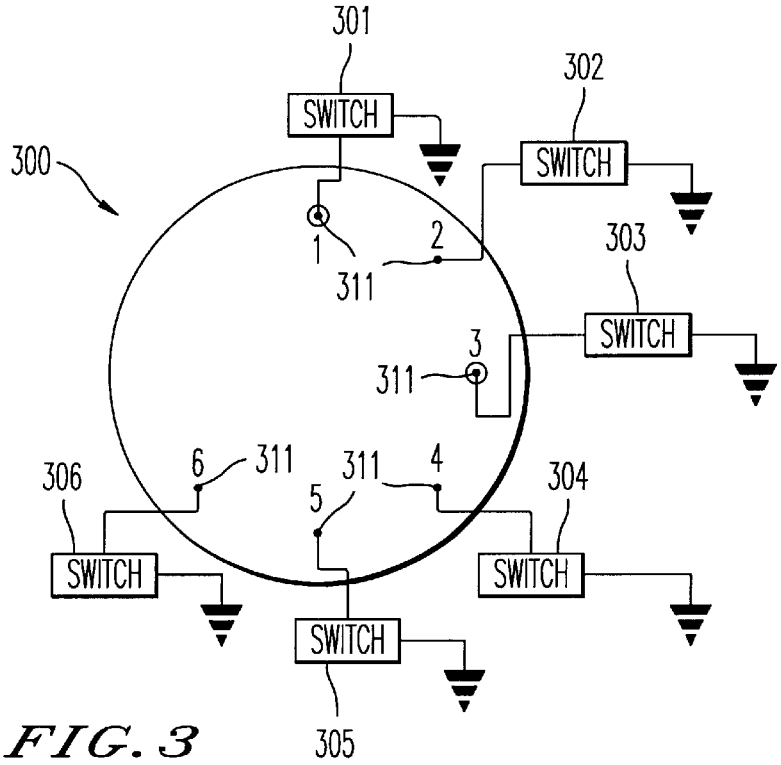
FIG. 3 is a diagram of an antenna element having a circular patch coupled to single switches, in accordance with an embodiment of the present invention.

FIG. 3 shows a diagram of an antenna element having a circular patch with taps coupled to single switches, in accordance with an embodiment of the present invention. FIG. 3 provides an exemplary embodiment in which n-bit (n=2) quantization is used. The circular patch 300 includes six taps 311 at positions 1–6, as shown in the figure. Each of the taps 311 has a corresponding switch 301–306, which are coupled to ground. For any phase setting, the patch-to-ground path encounters only a single switch element, thereby minimizing loss. The example of FIG. 3 is of a 2-bit phase quantization, in which the phases are represented as shown in Table 2, below:

TABLE 2

| TAP PAIRS | PHASE |
|---|---|
| 1–3 | 0°, 360° |
| 2–4 | 90° |
| 3–5 | 180° |
| 4–6 | 270° |

As evident from Table 2, the orthogonal tap pairs at positions 1-3, 2-4, 3-5, and 4-6, correspond to phases 0°, 90°, 180°, and 270°, respectively. The taps (or shorting points) are placed on orthogonal axes; these orthogonal tap pairs are positioned around the periphery of the circular patch 300 to achieve phase shift. For example, phase 0° is generated by closing switches 301 and 303, while the remaining switches 302, and 304–306 are open. It should be noted that the operation of the switches 301 306 in this manner advantageously yields identical boundary conditions for the signals. Identical boundary conditions exist because when switches 301 and 303 are closed, as in the case of 0° phase, the corresponding opposite axes are effectively in the open state. Two independent, identical orthogonal EM modes on the circular patch 300 are created for the horizontal and vertical axes. In other words, the signals associated with tap 311 at position 1 and tap 311 at position 3 exhibit orthogonal EM modes with identical amplitudes. Consequently, no axial ratio degradation attends this design as in the conventional design of FIG. 10.

Furthermore, advantageously, the circular patch 300, according to an embodiment of the present invention, requires few switches 301–306 than the conventional approach, thereby reducing production cost. It should be noted that if n-bit phase quantization is desired, the number of orthogonal tap pairs is $2^n$.

Figure 4:
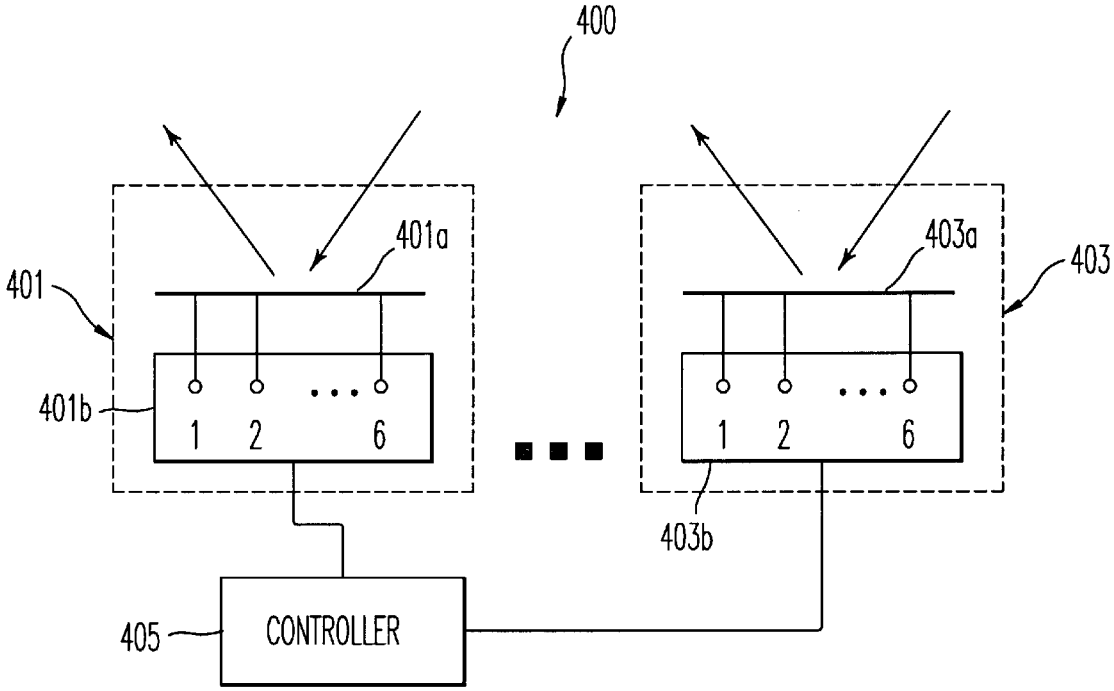
FIG. 4 is a diagram of an array antenna utilizing the antenna elements of FIG. 3, in accordance with an embodiment of the present invention.
Figure 7:
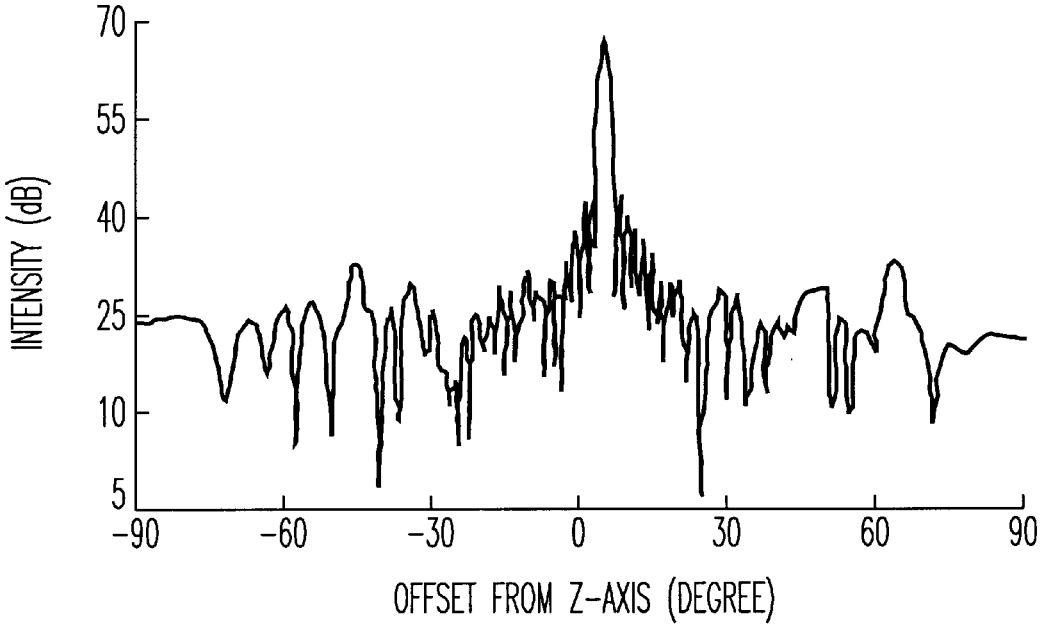
FIG. 7 is a graph of a radiation pattern in which the array antenna employs 2-bit quantization and random phase bias, in accordance with an embodiment of the present invention.
Figure 9:
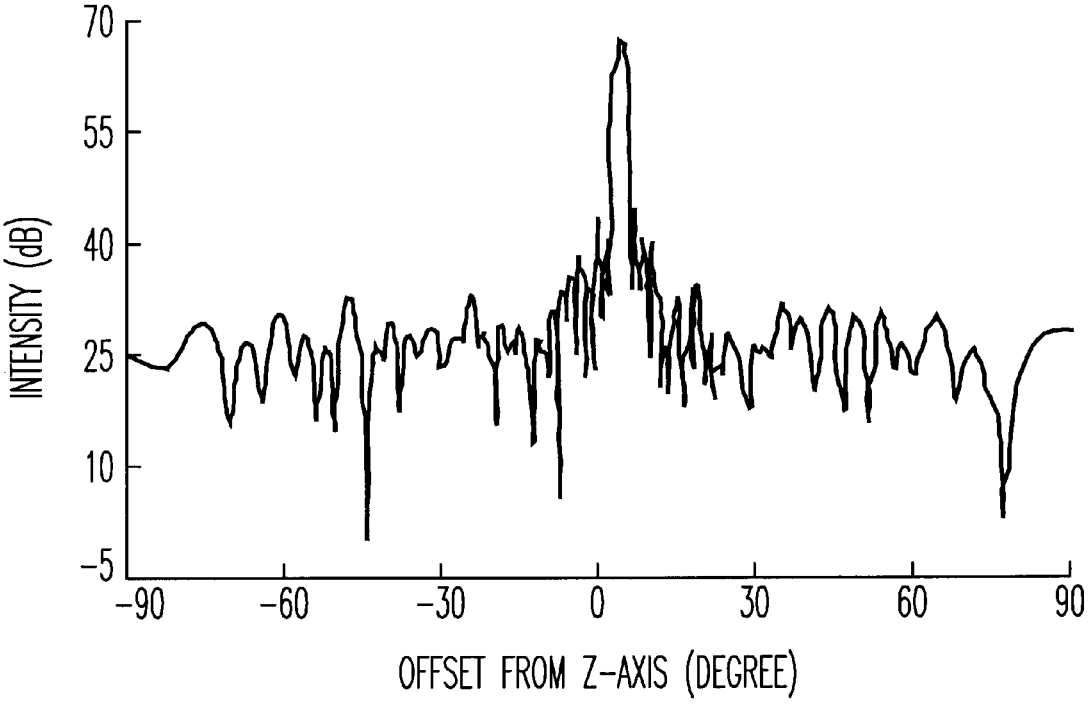
FIG. 9 is a graph of a radiation pattern of the array of FIG. 8.

FIG. 4 shows a diagram of an array antenna utilizing the antenna elements of FIG. 3, in accordance with an embodiment of the present invention. The array antenna 400 includes multiple array elements 401 and 403, which are electronically controlled by a controller 405. Array element 401, which includes a circular patch 401 *a* that is connected to switches 401*b* at the tap points (FIG. 3). Similarly, array element 403 has a circular patch 403*a* with six taps; the taps are coupled to switches 403*b*. The array elements 401 and 403 are individually controlled by controller 405. In an exemplary embodiment, the switches 401*b* and 403*b* are single-pole-double-throw switches. Depending on the particular application, the number of array elements 401 and 403 can vary from several hundred to several thousand. The results of the computer simulations, as shown in FIGS. 7 and 9, correspond to an array with 4447 array elements (as will be more fully described later).

FIG. 5A shows a diagram of the operation of a circular patch antenna, according to an embodiment of the present invention. Two transmit patches 501 and 503 are shown, wherein patch 503 is effectively rotated by an angle, ψ (as discussed below). Assuming Ex=Ey=E, the signals received at the far field for patches 501 and 503, respectively, are as follows:

$$E=XE+jYE \text{ (for patch } \mathbf{501}) \qquad \text{Eq.(4).}$$

$$E=(XE+jYE)\exp(j\psi) \text{ (for patch } \mathbf{503}) \qquad \text{Eq.(5).}$$

In Eq. (4) and Eq. (5), X and Y represent unit vectors.

By tapping at orthogonal locations on the patch 501, orthogonal EM fields are created in the directions shown by the arrows. A Circular Polarized (CP) wave can be created by applying equal amplitude and quadrature phase signals, Ex and jEy to these tap points. The coordinate of the receive system is assumed to be that of transmit patch 501. By physically moving the tap pair location on patch 503 by an angle ψ, the EM field received from 503 will have a phase offset of ψ. In the typical reflect array, the incident and reflection wave therefore undergoes a net phase shift of 2ψ. This phase offset is exactly equivalent to applying a phase shift of ψ to the Ex and Ey signals of patch 503 with reference to a patch with tap locations as patch 501.

In light of the above principle, conventional phase shifters can be eliminated entirely, as seen in the array element of FIG. 5B. FIG. 5B, by way of example, shows a side view of a PIN diode implementation of the array element, in accordance with an embodiment of the present invention. As shown, a circular patch 521 is disposed on a substrate 523. A PIN diode 525 is used to perform the necessary switching function in the phase shifting operation. The PIN diode 525 is attached to the bottom surface of the substrate 523. The taps of the circular patch 521 are connected to the P-region inputs 525*a* of the PIN diode 525 through via 527 with appropriate DC blocking, while the N-region 525 is connected to RF ground. Six control lines (of which only one is shown) 529 are connected to the vias 527 to bias the diodes. A ground (GND) shield 531 is connected to the main ground via the shorting vias 533 to prevent control line emissions from radiating outside the array. Shorting a selected tap location to ground provides a reflective phase shifter, which is well suited to a reflectarray design (FIG. 1).

All patches (e.g., 521) on the array are provided with normally off switch taps to ground uniformly spread around the periphery so that an orthogonal pair can always be selected. Although FIG. 5B shows implementation of PIN-diodes, any single-pole-single-throw switch can be utilized, as long the switch has high off-isolation; i.e., the switch does not load the patch toward impracticality. Alternatively, the switches may be single-pole-double-throw switches. By turning on a switch-pair at the desired orthogonal taps of the patch, a reflected EM circular polarized wave is created with electrical phase shift equal to twice the physical rotation angle from the reference axis. Also, the signal travels through the diode 525 twice.

The arrangement shown in FIG. 5B supports a 2-bit quantization, utilizing either LHCP (Left-Hand Circular Polarization) or RHCP (Right-Hand Circular Polarization).

Another advantage of the above approach is with respect to high frequency applications. As an example, when the frequency of operation is in the Ka-band, in which inter-element spacing is small, a large number of PIN-diodes, for example, can be fabricated on a single wafer, as a sub-array. Thus, only a few such wafers will form the entire array, thereby reducing production cost.

Figure 6:
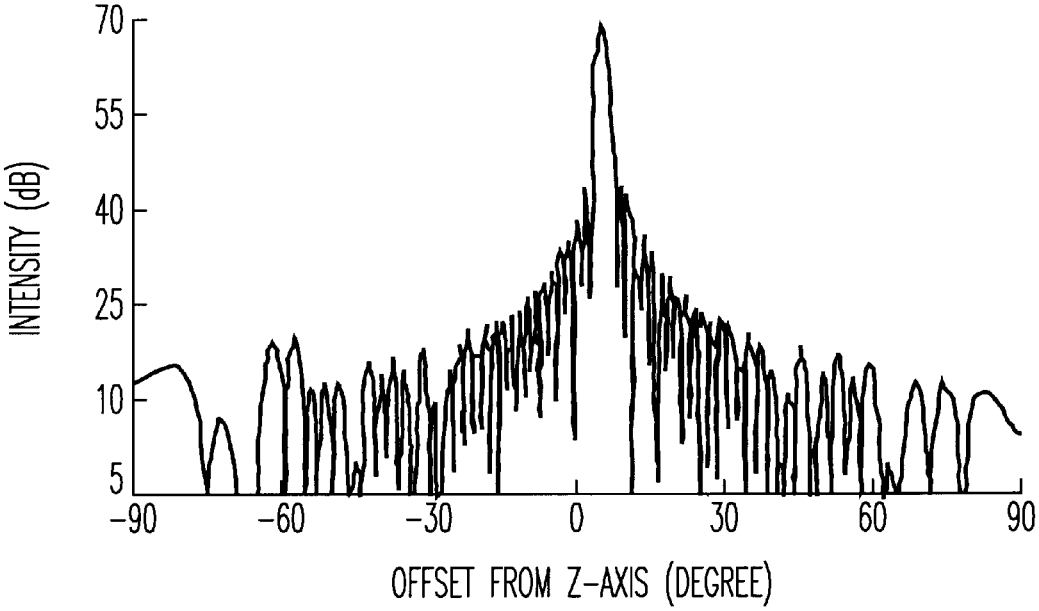
FIG. 6 is a graph of a Taylor distribution associated with an ideal radiation pattern with no quantization.

FIG. 6 is a graph of a Taylor distribution associated with a radiation pattern with no quantization. The pattern shown in FIG. 6 represents an ideal case, serving as a basis for comparison to the simulation results of FIGS. 7 and 9. In contrast to the radiation pattern of FIG. 12, which uses no phase bias and 2-bit quantization the pattern of FIGS. 7 and 9 essentially shows one main lobe with effectively no appreciable sidelobes.

FIG. 7 is a graph of a radiation pattern in which the array antenna employs 2-bit quantization and random phase bias, in accordance with an embodiment of the present invention; and FIG. 9 employs deterministic phase bias and 2-bit quantization. The quality or performance of the array is defined by the level of sidelobes that are present when steering a beam to some small angle. As previously discussed, array performance is dependent on the combination of the initial phase Un and the phase bias Vn. This dependency is particularly noticeable when coarse quantization (e.g., 2-bit quantization) is used.

A number of computer simulations have been run based upon the approach of the present invention. The computer simulations utilized an array with the following parameters, as shown in Table 3 below:

TABLE 3

| | |
|---|---|
| Number of Elements | 4447 on circular aperture |
| Amplitude Taper | Taylor Distribution, n = 3, SLL = 25 dB |
| Antenna Diameter | 35λ |
| Inter-element Spacing | 0.5λ |
| Desired beam position: | |
| $\theta_o$ | 5.0 Degrees |
| $\phi_o$ | 0.0 Degrees |
| Quantization | 2-bits |

Two-bit quantization gives four possible values for Qn, which are, for example, 45°, 135°, −45° and −135°. The plots in FIGS. 7 and 9 show the field intensity (E.E*) as a function of the angle δ, an offset relative to the Z-axis and measured in the X-Z plane ($\phi_o$=0), while the desired beam is pointed at $\phi_o$=5.0°.

FIG. 7 shows the effect of 2-bit quantization in the presence of random bias applied at each element. This particular case uses a uniformly distributed random variable in the 0°–360° range. The incident phase is assumed to be zero. The sidelobes are substantially suppressed; and, it is observed that the directivity is only 1 dB worse than the ideal case. As evident from the figure, further embedding a phase bias in the array layout, the performance of ESRA with only 2-bit quantization approaches the case with no quantization (FIG. 6).

FIG. 8 shows a planar array antenna that employs 2-bit quantization, according to an embodiment of the present invention. The array system 800 has a feed 801 located such that the point source is at the vertex of a cone, forming a cone-angle of 60° with the edge of the array surface 803. The feed 801 produces a spherical wave front, which causes a differential phase delay with respect to each of the array elements (not shown). The illumination geometry, as determined by the location of the feed 801 with respect to the planar array surface 803, provides a fixed phase bias. In other words, each array element (not shown) experiences a phase bias that is deterministic, which is a desirable result (as discussed previously). As revealed by the simulation result of FIG. 9, this fixed phase bias permits the use of a coarse quantization as well.

FIG. 9 is a graph of a radiation pattern in which a planar array antenna employs 2-bit quantization and has a feed that stimulates a spherical wavefront, in accordance with an embodiment of the present invention. Specifically, the simulation assumes the parameters of the array 800 (FIG. 8). The incident phase is deterministic, while the bias is set to zero. Essentially, the incident phase is based on a spherical wave front incident on a flat surface. In other words, the linear distance measured from the point source to each array element in units of wavelength gives the phase value at that element (1wavelength=360°). As seen in FIG. 9, the directivity is within a 1 dB and the sidelobes are down to the same level as the previous simulation case (FIG. 7).

The simulation results demonstrate that the combination, or the sum, of phase bias and incident phase must be perturbed either deliberately or obtained naturally (i.e., based upon the geometric position of the array elements with respect to the source) to achieve good performance from coarse quantization. Furthermore, the perturbation can be random or deterministic.

The above characteristics are applicable to any array type; for example, reflectarray, lens or typical active phased array with corporate feed. Also, the present invention has applicability to linear polarization as well as circular polarization.

Figure 10:
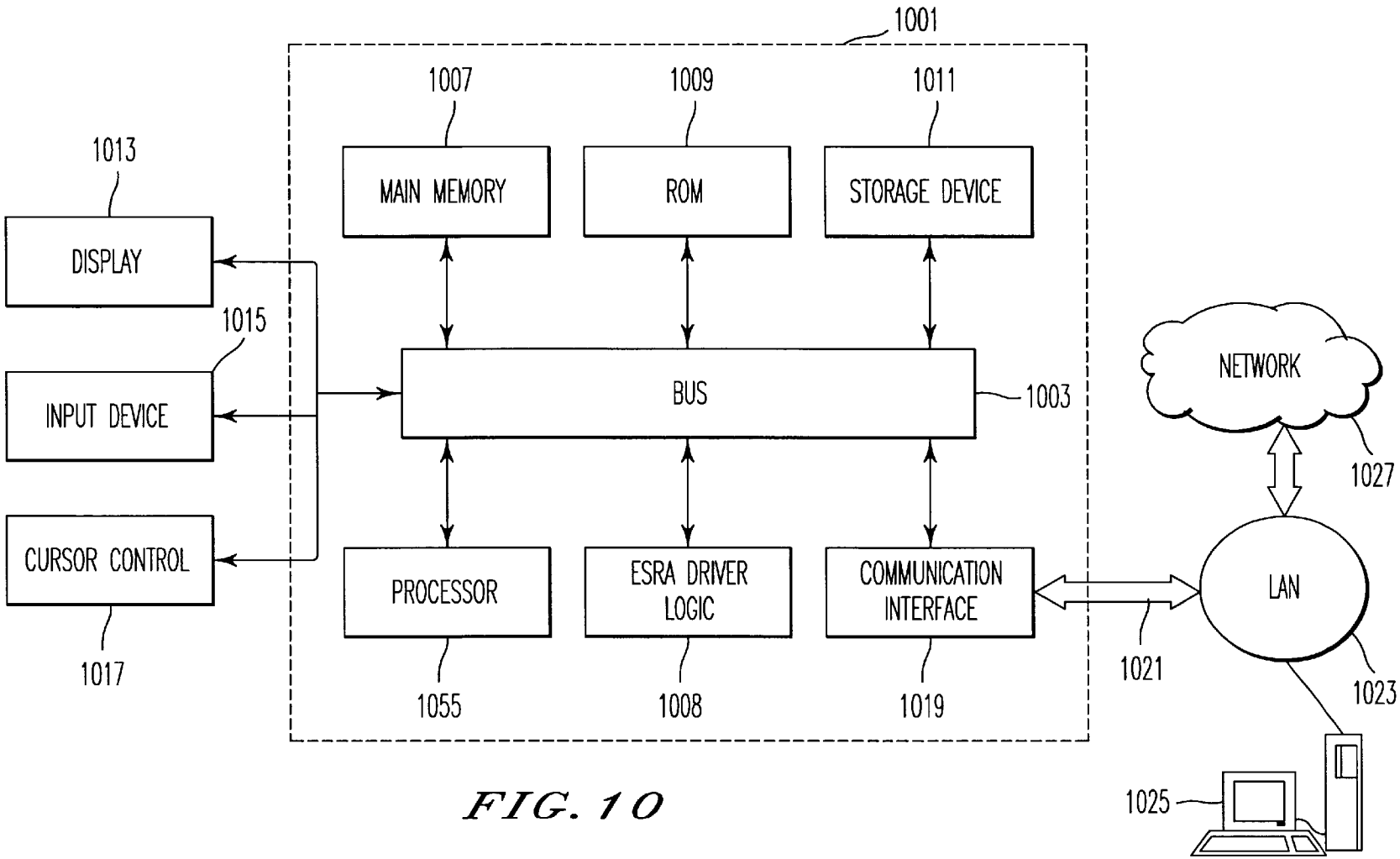
FIG. 10 is a diagram of a computer system that can control switches of the array antenna of FIG. 3, in accordance with an embodiment of the present invention.
Figure 11:
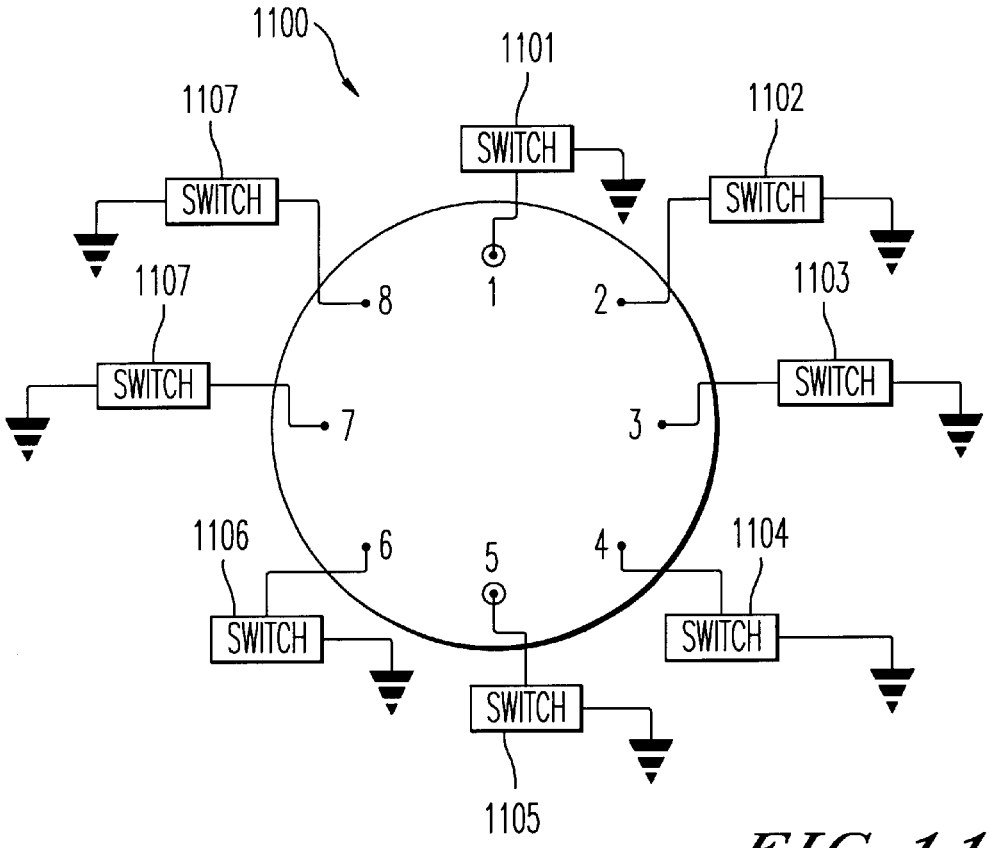
FIG. 11 PRIOR ART
FIG. 11 is a diagram of a conventional circular patch in which a tap pair is opposite each other to achieve phase shifts.

FIG. 10 illustrates a computer system 1001 upon which an embodiment according to the present invention may be implemented to control the switches of the array elements. Computer system 1001 includes a bus 1003 or other communication mechanism for communicating information, and a processor 1005 coupled with bus 1003 for processing the information. Computer system 1001 also includes a main memory 1007, such as a random access memory (RAM) or other dynamic storage device, coupled to bus 1003 for storing information and instructions to be executed by processor 1005. In addition, main memory 1007 may be used for storing temporary variables or other intermediate information during execution of instructions to be executed by processor 1005. Computer system 1001 further includes a read only memory (ROM) 1009 or other static storage device coupled to bus 1003 for storing static information and instructions for processor 1005. A storage device 1011, such as a magnetic disk or optical disk, is provided and coupled to bus 1003 for storing information and instructions.

Computer system 1001 may be coupled via bus 1003 to a display 1013, such as a cathode ray tube (CRT), for displaying information to a computer user. An input device 1015, including alphanumeric and other keys, is coupled to bus 1003 for communicating information and command selections to processor 1005. Another type of user input device is cursor control 1017, such as a mouse, a trackball, or cursor direction keys for communicating direction information and command selections to processor 1005 and for controlling cursor movement on display 1013.

According to one embodiment, turning the switches within the array elements on and off is provided by computer system 1001 in response to processor 1005 executing one or more sequences of one or more instructions contained in main memory 1007. Such instructions may be read into main memory 1007 from another computer-readable medium, such as storage device 1011. Execution of the sequences of instructions contained in main memory 1007 causes processor 1005 to perform the process steps described herein. One or more processors in a multi-processing arrangement may also be employed to execute the sequences of instructions contained in main memory 1007. In alternative embodiments, hard-wired circuitry may be used in place of or in combination with software instructions. Thus, embodiments are not limited to any specific combination of hardware circuitry and software. For example, alternatively, a separate ESRA driver logic 1008 can be employed to control the reflectarray 100 (FIG. 1).

Further, the control logic to perform shorting of the taps on the circular patch (FIG. 3) may reside on a computer-readable medium. The term "computer-readable medium" as used herein refers to any medium that participates in providing instructions to processor 1005 for execution. Such a medium may take many forms, including but not limited to, non-volatile media, volatile media, and transmission media. Non-volatile media includes, for example, optical or magnetic disks, such as storage device 1011. Volatile media includes dynamic memory, such as main memory 1007. Transmission media includes coaxial cables, copper wire and fiber optics, including the wires that comprise bus 1003. Transmission media can also take the form of acoustic or light waves, such as those generated during radio wave and infrared data communication.

Common forms of computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a computer can read.

Various forms of computer readable media may be involved in carrying one or more sequences of one or more instructions to processor 1005 for execution. For example, the instructions may initially be carried on a magnetic disk of a remote computer. The remote computer can load the instructions relating to turning the switches within the array elements on and off remotely into its dynamic memory and send the instructions over a telephone line using a modem. A modem local to computer system 1001 can receive the data on the telephone line and use an infrared transmitter to convert the data to an infrared signal. An infrared detector coupled to bus 1003 can receive the data carried in the infrared signal and place the data on bus 1003. Bus 1003 carries the data to main memory 1007, from which processor 1005 retrieves and executes the instructions. The instructions received by main memory 1007 may optionally be stored on storage device 1011 either before or after execution by processor 1005.

Computer system 1001 also includes a communication interface 1019 coupled to bus 1003. Communication interface 1019 provides a two-way data communication coupling to a network link 1021 that is connected to a local network 1023. For example, communication interface 1019 may be a network interface card to attach to any packet switched local area network (LAN). As another example, communication interface 1019 may be an asymmetrical digital subscriber line (ADSL) card, an integrated services digital network (ISDN) card or a modem to provide a data communication connection to a corresponding type of telephone line. Wireless links may also be implemented. In any such implementation, communication interface 1019 sends and receives electrical, electromagnetic or optical signals that carry digital data streams representing various types of information.

Network link 1021 typically provides data communication through one or more networks to other data devices. For example, network link 1021 may provide a connection through local network 1023 to a host computer 1025 or to data equipment operated by a service provider, which provides data communication services through a communication network 1027 (e.g., the Internet). LAN 1023 and network 1027 both use electrical, electromagnetic or optical signals that carry digital data streams. The signals through the various networks and the signals on network link 1021 and through communication interface 1019, which carry the digital data to and from computer system 1001, are exemplary forms of carrier waves transporting the information. Computer system 1001 can transmit notifications and receive data, including program code, through the network (s), network link 1021 and communication interface 1019.

The techniques described herein provide several advantages over prior approaches to electronic beam steering. According to one aspect of the present invention, the application of phase perturbation (phase bias), either randomly or deterministically, enhances coarse quantization performance; this approach can be applied to reflectarrays, lens or other type of active or passive phased arrays. Based upon simulation results, it has been demonstrated that even with 2-bit quantization of the scan phase shifter, array performance within 1 dB directivity of the ideal case can be achieved by applying a random or deterministic bias. The bias can be applied from the inherent illumination geometry, or can be deliberately embedded into the array design. In another aspect of the present invention, phase shifting of circular polarized waves can be efficiently performed by providing uniformly distributed normally off switched taps on the periphery of circular patches of a reflectarray or a lens. Scan phase shift can be achieved by switching on an orthogonal tap pair. This design provides a low loss configuration for phase shifting; and in high frequency applications, the approach offers convenience of integration.

Obviously, numerous modifications and variations of the present invention are possible in light of the above teachings. It is therefore to be understood that within the scope of the appended claims, the invention may be practiced otherwise than as specifically described herein.

What is claimed is:

1. A method of performing electronic beam steering using a circular patch having a plurality of taps coupled to a plurality of switches, the method comprising:

controlling the plurality of switches to short an orthogonal pair of the plurality of taps to provide a phase shift, the taps being arranged on the circular patch to provide identical boundary conditions; and selectively performing at least one of receiving a signal and transmitting the signal.

2. The method according to claim 1, further comprising:

applying a fixed phase bias based upon geometric positioning of the circular patch.

3. The method according to claim 1, wherein the signal in the step of selectively performing is circularly polarized.

4. The method according to claim 1, wherein the signal in the step of selectively performing is linearly polarized.

5. A method of performing electronic beam steering using a circular patch having a plurality of taps coupled to a plurality of switches, the method comprising:

controlling the plurality of switches to short an orthogonal pair of the plurality of taps, the taps being arranged on the circular patch to provide identical boundary conditions;

selectively performing at least one of receiving a signal and transmitting the signal; and applying a fixed phase bias of a predetermined distribution to the signal, the predetermined distribution being at least one of a deterministic distribution and a random distribution.

6. An antenna apparatus comprising:

a circular patch having a plurality of orthogonal tap pairs arranged on the patch;

a plurality of switches corresponding to the taps, each of the switches being coupled to ground; and a controller configured to control the switches to short one of the orthogonal tap pairs corresponding to a phase shift of a signal having orthogonal EM (electromagnetic) modes, wherein the patch as controlled by the controller provides identical boundary conditions for the orthogonal EM modes.

7. The apparatus according to claim 6, wherein the circular patch is configured to provide n-bit phase quantization.

8. The apparatus according to claim 6, wherein the circular patch is configured to provide 2-bit phase quantization.

9. The apparatus according to claim 6, wherein the plurality of switches are PIN diodes.

10. The apparatus according to claim 6, wherein each of the plurality of switches is at least one of a single-pole-single-throw switch and a single-pole-double-throw switch.

11. The apparatus according to claim 6, wherein the signal is circularly polarized.

12. The apparatus according to claim 6, wherein the signal is linearly polarized.

13. An antenna apparatus comprising:

a circular patch having a plurality of orthogonal tap pairs arranged on the patch;

a plurality of switches corresponding to the taps, each of the switches being coupled to ground;

a controller configured to control the switches to short one of the orthogonal tap pairs corresponding to orthogonal EM (electromagnetic) modes; and a plurality of phase perturbing sources coupled to the taps to apply a fixed phase bias of a predetermined distribution, the predetermined distribution being at least one of a deterministic distribution and a random distribution, wherein the patch as controlled by the controller provides identical boundary conditions for the orthogonal EM modes.

14. An antenna system for beam steering, comprising:

a plurality of antenna elements being spaced according to a predetermined distance value, each of the plurality of antenna elements comprising, a circular patch having a plurality of orthogonal tap pairs arranged on the patch, a plurality of switches corresponding to the taps, each of the switches being coupled to ground, and a plurality of phase perturbing sources coupled to the taps to apply a fixed phase bias of a predetermined distribution, the predetermined distribution being at least one of a deterministic distribution and a random distribution; and a controller configured to control individually the plurality of antenna elements, the controller controlling the switches of one of the plurality of antenna elements to short one of the orthogonal tap pairs corresponding to a phase shift of a signal having orthogonal EM (electromagnetic) modes, wherein the circular patch as controlled by the controller provides identical boundary conditions for the orthogonal EM modes.

15. The system according to claim 14, wherein the antenna elements are spaced according to a predetermined value.

16. The system according to claim 15, wherein the predetermined value is 0.5λ.

17. The system according to claim 14, wherein the number of antenna elements is greater than about 4,000.

18. The system according to claim 14, wherein the circular patch is configured to provide n-bit phase quantization.

19. The system according to claim 14, wherein the circular patch is configured to provide 2-bit phase quantization.

20. The system according to claim 14, wherein the plurality of switches are PIN diodes.

21. The system according to claim 14, wherein each of the plurality of switches is at least one of a single-pole-single-throw switch and a single-pole-double-throw switch.

22. The system according to claim 14, wherein the signal is circularly polarized.

23. The system according to claim 14, wherein the signal is linearly polarized.

24. A computer-readable medium carrying one or more sequences of one or more instructions for performing electronic beam steering using a circular patch having a plurality of taps coupled to a plurality of switches, the one or more sequences of one or more instructions including instructions which, when executed by one or more processors, cause the one or more processors to perform the steps of:

controlling the plurality of switches to short an orthogonal pair of the plurality of taps to provide a phase shift, the taps being arranged on the circular patch to provide identical boundary conditions; and selectively performing at least one of receiving a signal and transmitting the signal.

25. The computer-readable medium according to claim 24, wherein the signal in the step of selectively performing is circularly polarized.

26. The computer-readable medium according to claim 24, wherein the signal in the step of selectively performing is linearly polarized.

27. The computer-readable medium according to claim 24, wherein the one or more processors further perform the step of:

applying a fixed phase bias of a predetermined distribution to the signal, the predetermined distribution being at least one of a deterministic distribution and a random distribution.

* * * * *